US007559371B2

(12) United States Patent
Lynde et al.

(10) Patent No.: US 7,559,371 B2
(45) Date of Patent: Jul. 14, 2009

(54) METHOD AND APPARATUS FOR CENTRALIZING THROUGH TUBING MILLING ASSEMBLIES

(75) Inventors: Gerald D. Lynde, Houston, TX (US); Shantur S. Tapar, Houston, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 47 days.

(21) Appl. No.: 11/602,811

(22) Filed: Nov. 21, 2006

(65) Prior Publication Data

US 2008/0115972 A1 May 22, 2008

(51) Int. Cl.
*E21B 19/24* (2006.01)
*E21B 29/06* (2006.01)

(52) U.S. Cl. ..... 166/298; 166/117.6; 166/241.6; 166/382

(58) Field of Classification Search ..... 166/382, 166/241.6, 298, 117.6
See application file for complete search history.

(56) References Cited

U.S. PATENT DOCUMENTS 5,758,723 A * 6/1998 Saucier et al. ..... 166/55.8
5,785,120 A 7/1998 Smalley et al.
5,785,125 A * 7/1998 Royer ..... 166/380
5,909,770 A 6/1999 Davis
6,457,519 B1 * 10/2002 Buytaert ..... 166/241.6
6,863,131 B2 3/2005 Richard
6,896,052 B2 5/2005 Simpson et al.
2002/0112853 A1 * 8/2002 Buytaert ..... 166/241.6
2003/0230411 A1 * 12/2003 Richard ..... 166/384
2004/0244967 A1 * 12/2004 Armell ..... 166/241.6

* cited by examiner

*Primary Examiner*—Hoang Dang
(74) *Attorney, Agent, or Firm*—Steve Rosenblatt

(57) ABSTRACT

A through tubing centralizer is delivered below the tubing and expanded against a surrounding tubular for fixation. In a window milling through tubing application, a whipstock is delivered through tubing and anchored. One or more centralizers are then delivered through tubing and expanded so that their inside diameter when set exceeds their outside diameter during run in. They are placed below the tubing and above the whipstock to help a through tubing mill stay on the whipstock ramp while milling the window. After the window is started, the centralizer can be expanded fully against the surrounding tubular to allow subsequent removal of the whipstock. Optionally, the centralizer can be collapsed for removal through tubing.

30 Claims, 6 Drawing Sheets

METHOD AND APPARATUS FOR CENTRALIZING THROUGH TUBING MILLING ASSEMBLIES

FIELD OF THE INVENTION

The field of the invention is window milling using a through tubing whipstock where the surrounding casing is substantially larger than the tubing inside diameter.

BACKGROUND OF THE INVENTION

During the life of a well a time can come when a lateral needs to be drilled to enhance production from a production from a producing zone or to penetrate a different zone. Since production tubing is in the well when the lateral needs to be drilled after a window is formed, it was deemed advantageous to be able to run a whipstock through the production tubing and anchor it in the larger casing. A milling assembly that also fit through tubing could also then be introduced to produce the window. Through tubing retrievable whipstocks were developed for this purpose and an illustrative one is U.S. Pat. No. 5,909,770.

However, in the past there were limits to this technique. It was used when the size of the tubing inside diameter was not substantially smaller than the inside diameter of the surrounding tubular, generally casing. The concern that remained unresolved in the past that limited the application of through tubing window milling is that in applications with greater ratios of tubing inside diameter to casing inside diameter the size of the through tubing whipstock that fit through tubing would leave large gaps on either side of the much larger surrounding casing so that the advancing mill could literally run off the sides of the whipstock or miss the whipstock ramp totally. If this happened the window or exit would be oriented incorrectly for the desired lateral to be later drilled. One way this situation was avoided was to pull all the production tubing and go in with a full sized whipstock, cut the window, drill the well to depth and then complete the well with the necessary completion equipment. Clearly, this required a lot of time and created a substantial cost. The problem was that no other alternatives were known.

The present invention is directed toward a solution. It provides a centralizer that can be inserted through tubing and subsequently expanded so that it is anchored and has a central passage larger than its run in outside diameter. Since the percent expansion of the centralizer is well above 30% beyond its run in dimension, the centralizer is configured to make such dramatic dimension changes while retaining the structural strength to guide a mill to track a whipstock ramp without going off one side or the other. The centralizer can be a cylinder that is slotted or alternatively a design with energized cantilevered fingers that can be allowed to spring out when the centralizer is properly placed. If a cylinder is used its opposed ends can be expanded for fixation leaving a smaller dimension in between for guidance of a mill.

Techniques for tubular expansion involving a high degree of expansion are illustrated in U.S. Pat. No. 6,896,052. Techniques involving performing a tubular and then using expansion to return it to its original shape which is larger than its run in dimension are illustrated in U.S. Pat. No. 5,785,120. Tubular screens have also been expanded downhole, as illustrated in U.S. Pat. No. 6,863,131.

Those skilled in the art will appreciate the various aspects of the present invention from a review of the description of the preferred embodiment and the associated drawings while recognizing that the full scope of the invention is to be found in the attached claims.

SUMMARY OF THE INVENTION

A through tubing centralizer is delivered below the tubing and expanded against a surrounding tubular for fixation. In a window milling through tubing application, a whipstock is delivered through tubing and anchored. One or more centralizers are then delivered through tubing and expanded so that their inside diameter when set exceeds their outside diameter during run in. They are placed below the tubing and above the whipstock to help a through tubing mill stay on the whipstock ramp while milling the window. After the window is started, the centralizer can be expanded fully against the surrounding tubular to allow subsequent removal of the whipstock. Optionally, the centralizer can be collapsed for removal through tubing.

DETAILED DESCRIPTION OF THE PREFERRED EMBODIMENT

Figure 1:
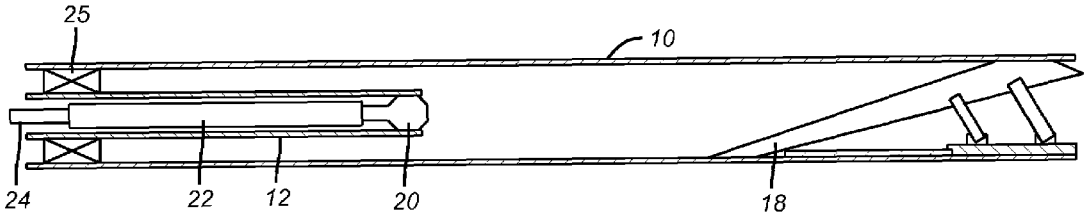
(PRIOR ART) FIG. 1
FIG. 1 is a section view showing the issue with through tubing milling in the prior art.
Figure 2:
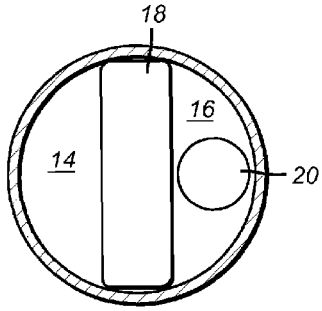
(PRIOR ART) FIG. 2
FIG. 2 illustrates the prior art problem of the mill running off the whipstock.

FIGS. 1 and 2 illustrate the problem in the past. If the casing 10 is 7 inch and has an inside diameter of 6.09 inches and the tubing 12 is 2 and ⅞ inches with an inside diameter of 2.44 inches, there are large gap areas 14 and 16 on opposed sides of the whipstock 18. The size of the whipstock 18 as well as the mill 20 is limited by the inside diameter of the tubing 12. However, in some cases the inside diameter of the casing 10 is so much larger that mil 20 can literally go completely off the whipstock 18 and into area 14 or 16, as shown in FIG. 2. FIG. 1 also shows a preferred way to drive the through tubing mill 20 using a mud motor 22 connected to coiled tubing 24 extending from the surface. The whipstock 18 is a retrievable through tubing design known in the art such as illustrated in U.S. Pat. No. 5,909,770, for example. The packer 26 is a known design to fit between the casing 10 and the tubing 12. The problem is how to keep a small though tubing mill 20 tracking on the through tubing whipstock 18 when the surrounding casing 10 is so large that the side areas 14 or 16 are so wide so as to allow more than half the mill 20 to run off the whipstock 18 during window milling.

Figure 3:
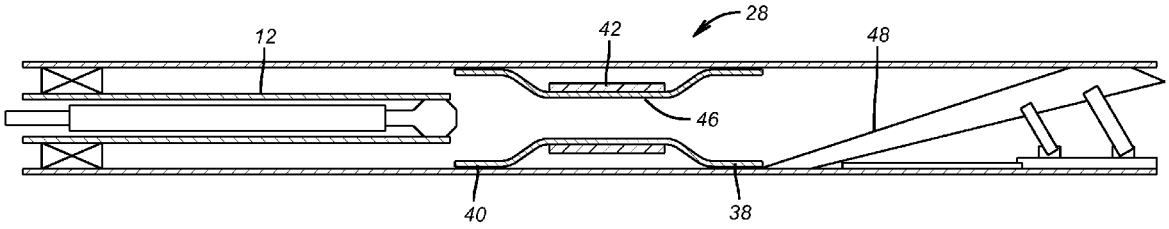
FIG. 3 shows a centralizer run through tubing and anchored between the tubing lower end and the whipstock.
Figure 4:
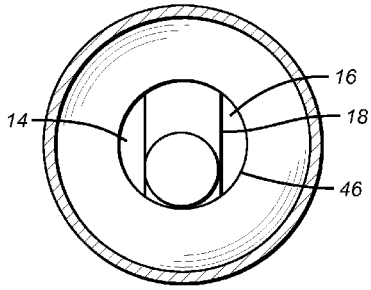
FIG. 4 shows how the centralizer keeps the through tubing mill on track on the whipstock ramp.
Figure 6:
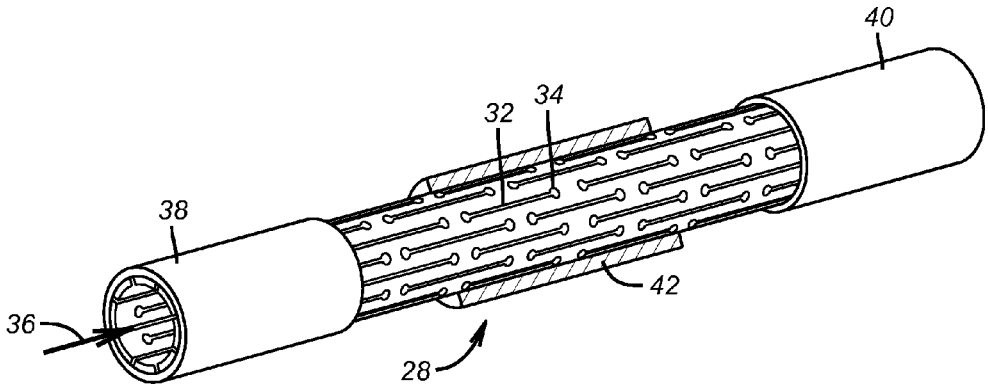
FIG. 6 is a perspective view of one embodiment of the through tubing centralizer shown in the run in dimension.
Figure 10:
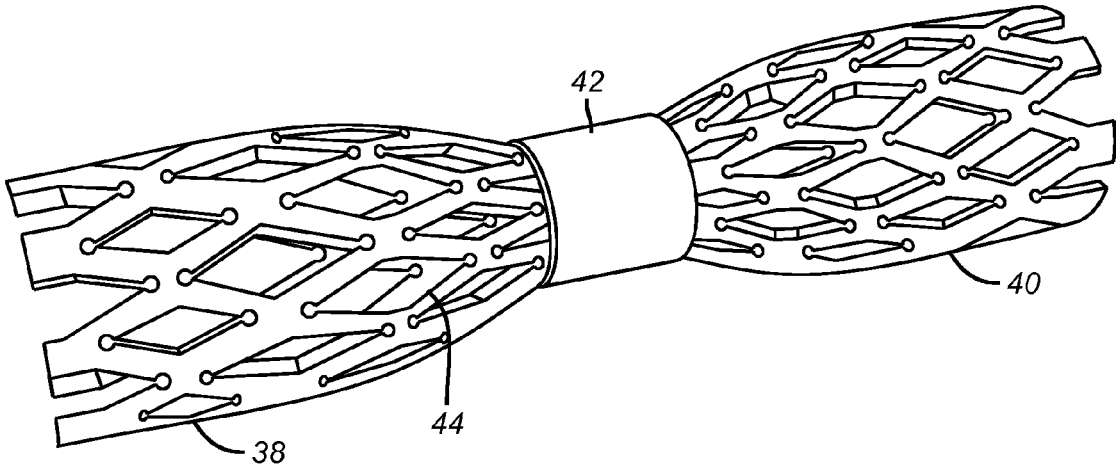
FIG. 10 is an expanded view of the centralizer shown without the surrounding tubular.
Figure 11:
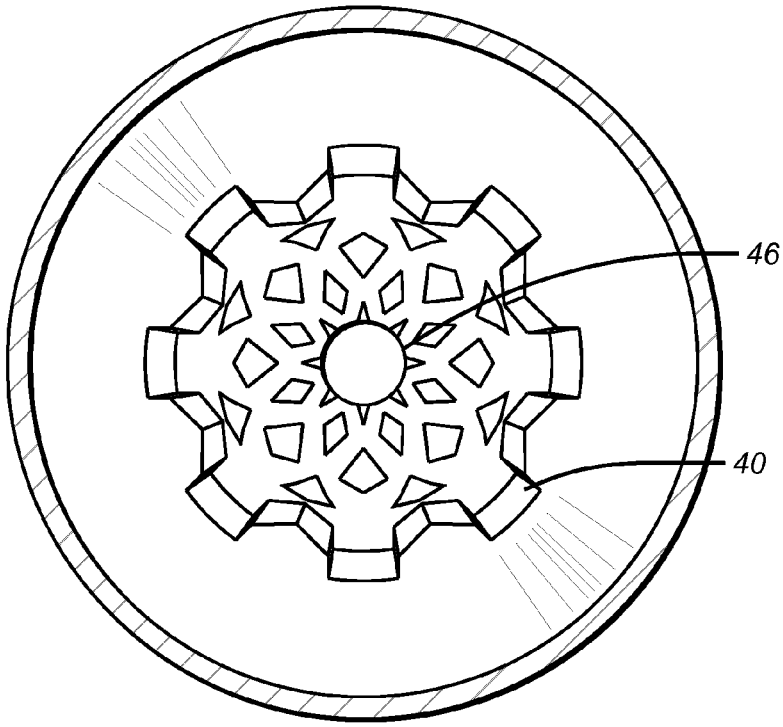
FIG. 11 is an end view of the expanded centralizer of FIG. 10.

FIG. 3 is the same as FIG. 1 in all respects except that a centralizer 28 is inserted and set between the tubing 12 and the whipstock 18. Centralizer 28 is expandable. FIG. 6 shows one form of it in the run in condition. It features a tubular body 30 with longitudinally overlapping slits 32 that have enlarged ends 34 to minimize slit growth on expansion from within. An expansion device is schematically illustrated by arrow 36 and can preferably be an inflatable element. FIGS. 10 and 11 illustrate the hourglass shape that is obtained when the expansion device 36 is activated. At each end of the centralizer 28 are preferably rubber rings 38 and 40. These rings 38 and 40 remain attached to the structure of the body 30 on its exterior as gaps open up in body 30 from the expansion device 36. A retainer 42 provides increased resistance to expansion between rings 38 and 40 so that when the expansion device 36 is actuated, the hourglass shape shown in FIG. 10 with the open web diamonds 44 is created. As seen in FIG. 11, the smaller diameter 46 that is approximately midway between rings 38 and 40 becomes the guiding passage diameter for the mill 20 as shown in FIG. 3. After expansion, the diameter 46 can wind up being larger than the outside diameter of the centralizer 28 as it is run though tubing 12. FIG. 4 shows how the smaller diameter 46 aligns with the center of the whipstock 18 so as to guide the mill along the whipstock 18 and away from the open areas 14 and 16. With centralizer 28 in position, the mill 20 is retained against running off the whipstock 18 and instead guided along the whipstock ramp 48 to properly orient and initiate the window. The ends at rings 38 and 40 anchor into the inner wall of casing 10 to keep the centralizer from shifting while it guides the mill 20.

Figure 5:
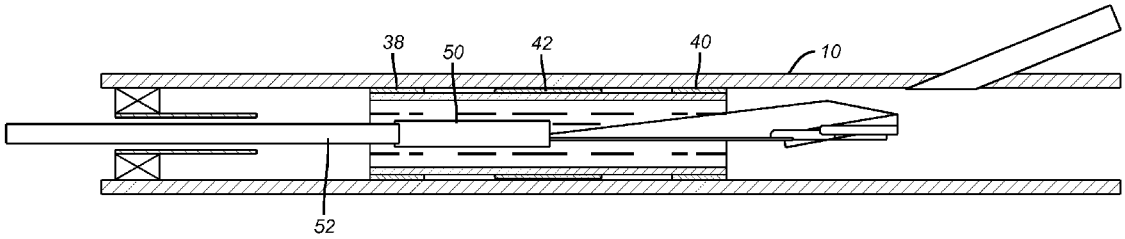
FIG. 5 shows the centralizer fully expanded to allow room to remove the through tubing whipstock.

After the milling is done, the whipstock 18 can be removed as shown in FIG. 5. Although the diameter 46 is large enough so that the whipstock 18 with its own anchors collapsed inwardly can pass through, it is far less likely to snag the whipstock 18 when trying to remove it if the centralizer is further expanded to a preferably flush position against the casing 10 with retainer 42 abutting it. At that point a known whipstock retrieving tool 50 can be run in on coiled tubing 52, for example, and the whipstock 18 easily comes through the centralizer 28 that now has resumed a much larger cylindrical shape as compared to its run in cylindrical dimension.

Figure 7:
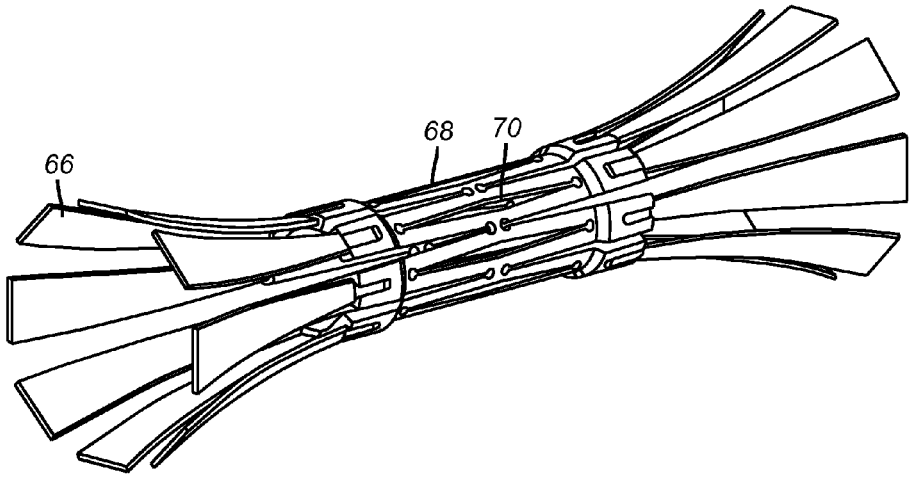
FIG. 7 is an alternative centralizer with cantilevered fingers shown in the fingers sprung position.

FIG. 7 illustrates another embodiment for a centralizer 54. It has a tubular shape with longitudinal slits 56 to define a series of cantilevered fingers 58. Yet other slits 60 are offset from slits 56 and do not extend to either end. The structure is akin to a circumferential spring and is held in a smaller run in dimension with bands 62 and 64 near opposed ends. When delivered into position downhole, an expansion device can break the bands 62 and 64 so that they spring radially out for an anchoring grip on the casing 10 while the center remains smaller for purposes of guiding the mill 20.

Figure 9:
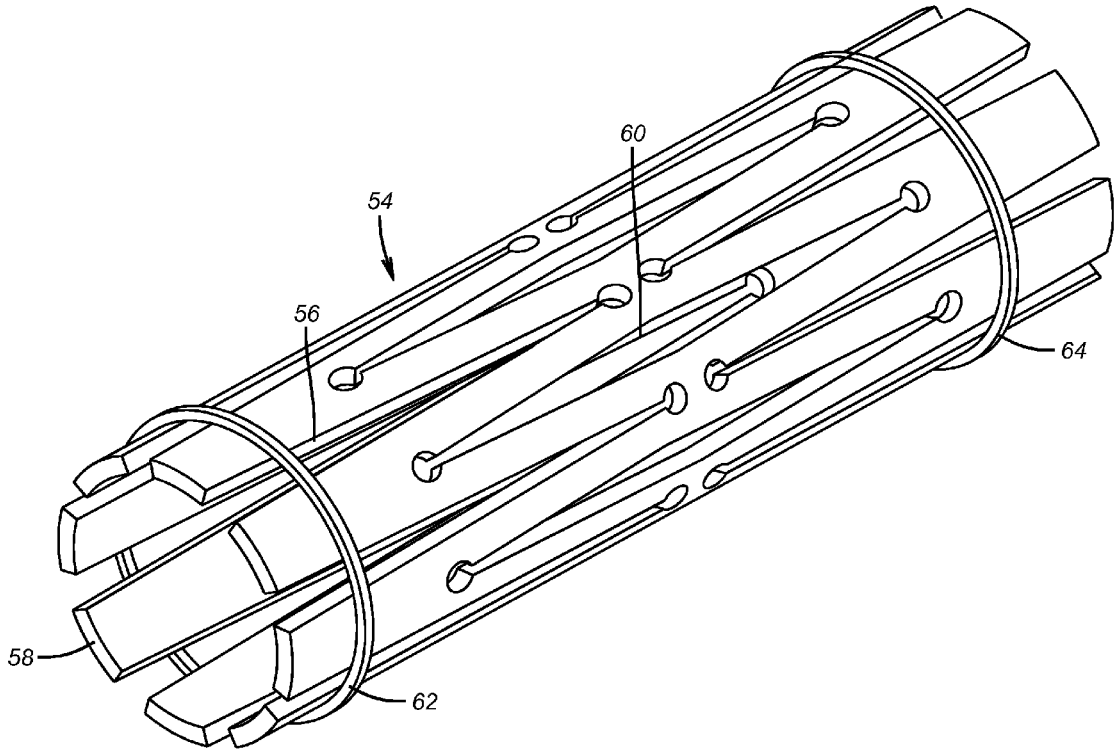
FIG. 9 is the centralizer of FIG. 7 in the restrained position for running in through tubing.

FIG. 9 is similar in that it uses cantilevered fingers 66 that are shown in the released position after a retainer for the ends has been released. The center portion 68 has slits 70 and can itself be increased in inside diameter beyond its run in dimension with an expansion tool such as 36.

Figure 8:
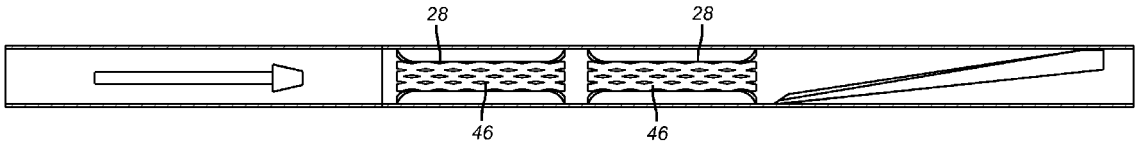
FIG. 8 shows how more than one centralizer can be used for a given installation.

FIG. 8 shows schematically that more than one centralizer 28 can be used at a time. Alternatively, a single centralizer body can be configured to have spaced guiding internal diameters 46.

Yet other alternatives for the expandable centralizer are envisioned. It may be made of a shape memory material so that it can be introduced through tubing and then well conditions can make it go to its anchored diameter near its ends for anchoring with the surrounding casing for the purposes of guiding. Thereafter, the well conditions can be changed again to allow the centralizer to sufficiently collapse so that it can be removed through tubing. Alternatively, with the centralizer designs previously described, retrieval is envisioned by either collapsing the expanded centralizer or otherwise structurally causing it to fail so that it can be removed through tubing without getting jammed. The anchored centralizer can be exposed to chemicals or pH that causes it to weaken or dissolve so that it can be grasped or simply circulated out if dissolved. Alternatively a reaming tool feature can be a part of the window mill so that after the window is started and the mill is pulled out, the reamer can be actuated to open arms to mill out the centralizer so that the cuttings can be circulated or reverse circulated out of the well.

Those skilled in the art will appreciate that the present invention introduces the concept of a through tubing centralizer. It further uses expansion to allow the centralizer to be run through tubing and set in larger tubing or casing. It allows a mill to be kept on track on a whipstock ramp that itself has been run through the same tubing as the mill. The centralizer can be further expanded after its guiding job is done to allow the whipstock to be recovered through tubing. The centralizer itself can be removed through tubing after it is deployed.

The above description is illustrative of the preferred embodiment and many modifications may be made by those skilled in the art without departing from the invention whose scope is to be determined from the literal and equivalent scope of the claims below.

We claim:

1. An apparatus for use in a wellbore where a smaller tubular string is positioned within a larger tubular string, comprising:

a centralizer having an initial outer dimension to pass through said smaller tubular string when delivered on a string and configured to be expanded for support from said larger tubular string and released from said string that delivered it for centralizing a downhole tool subsequently delivered through it on a string.

2. The apparatus of claim 1, wherein:

said centralizer, when supported by said larger tubular, has at least one guiding passage between opposed ends that is spaced from said larger tubular.

3. The apparatus of claim 2, wherein:

said centralizer after being supported by said larger tubular string is removable through said smaller tubular string.

4. The apparatus of claim 3, wherein:

said centralizer is removed by one of collapse, being dissolved or being milled.

5. An apparatus for use in a wellbore where a smaller tubular string is positioned within a larger tubular string, comprising:

a centralizer having an initial outer dimension to pass through said smaller tubular string and configured to be expanded for support from said larger tubular string for centralizing an object subsequently extending therethrough;

said centralizer, when supported by said larger tubular, has at least one guiding passage between opposed ends that is spaced from said larger tubular;

said opposed ends engage said larger tubular.

6. An apparatus for use in a wellbore where a smaller tubular string is positioned within a larger tubular string, comprising:

a centralizer having an initial outer dimension to pass through said smaller tubular string and configured to be expanded for support from said larger tubular string for centralizing an object subsequently extending therethrough;

said centralizer, when supported by said larger tubular, has at least one guiding passage between opposed ends that is spaced from said larger tubular;

said guiding passage is larger than said initial outer dimension of said centralizer.

7. An apparatus for use in a wellbore where a smaller tubular string is positioned within a larger tubular string, comprising:

a centralizer having an initial outer dimension to pass through said smaller tubular string and configured to be expanded for support from said larger tubular string for centralizing an object subsequently extending therethrough;

said centralizer, when supported by said larger tubular, has at least one guiding passage between opposed ends that is spaced from said larger tubular;

said centralizer has an initial cylindrical shape with a restraining member between said ends so that said guiding passage is formed when said ends are radially enlarged relative to the location of said restraining member.

8. The apparatus of claim 7, wherein:

said cylindrical shape comprises elongated slits.

9. The apparatus of claim 8, wherein:

said slits overlap longitudinally and open to a generally diamond shape when said ends contact said larger tubular string.

10. The apparatus of claim 9, wherein:

said ends are ringed with a material to enhance grip to said larger tubular string;

said material forms diamond shaped openings to conform to the underlying portions of said centralizer.

11. An apparatus for use in a wellbore where a smaller tubular string is positioned within a larger tubular string, comprising:

a centralizer having an initial outer dimension to pass through said smaller tubular string and configured to be expanded for support from said larger tubular string for centralizing an object subsequently extending therethrough;

said centralizer, when supported by said larger tubular, has at least one guiding passage between opposed ends that is spaced from said larger tubular;

said ends are coated with a material to enhance grip to said larger tubular string.

12. An apparatus for use in a wellbore where a smaller tubular string is positioned within a larger tubular string, comprising:

a centralizer having an initial outer dimension to pass through said smaller tubular string and configured to be expanded for support from said larger tubular string for centralizing an object subsequently extending therethrough;

said centralizer, when supported by said larger tubular, has at least one guiding passage between opposed ends that is spaced from said larger tubular;

said centralizer comprises a cylindrically shaped central portion with a plurality of cantilevered fingers extending therefrom in opposed directions having ends initially restrained for passage through said smaller tubular string, whereupon clearing said smaller tubular string, said restraints are released to allow said end to spring into contact with said larger tubular string.

13. The apparatus of claim 12, wherein:

said central portion comprises slits so that the guiding passage within can be larger than said initial outer dimension of said centralizer.

14. An apparatus for use in a wellbore where a smaller tubular string is positioned within a larger tubular string, comprising:

a centralizer having an initial outer dimension to pass through said smaller tubular string and configured to be expanded for support from said larger tubular string for centralizing an object subsequently extending therethrough;

said centralizer, when supported by said larger tubular, has at least one guiding passage between opposed ends that is spaced from said larger tubular;

said centralizer comprises a generally cylindrical shape comprising longitudinal slits alternating between extending to either end and extending between opposed ends to form cantilevered fingers that are initially retained against an outward bias for delivery through said smaller tubular string, said ends, when released, engaging said larger tubular string leaving said guiding passage disposed between said ends.

15. An apparatus for use in a wellbore where a smaller tubular string is positioned within a larger tubular string, comprising:

a centralizer having an initial outer dimension to pass through said smaller tubular string and configured to be expanded for support from said larger tubular string for centralizing an object subsequently extending therethrough;

said centralizer, when supported by said larger tubular, has at least one guiding passage between opposed ends that is spaced from said larger tubular;

said guiding passage is enlargeable for the passage of larger objects after centralizing is no longer needed.

16. An apparatus for use in a wellbore where a smaller tubular string is positioned within a larger tubular string, comprising:

a centralizer having an initial outer dimension to pass through said smaller tubular string and configured to be expanded for support from said larger tubular string for centralizing an object subsequently extending therethrough;

said centralizer, when supported by said larger tubular, has at least one guiding passage between opposed ends that is spaced from said larger tubular;

said centralizer is made of a shape memory material.

17. A through tubing window milling method, comprising:

delivering a whipstock through smaller tubing and setting it in larger tubing;

delivering a centralizer though said smaller tubing;

using said centralizer to maintain a mill on said whipstock while milling the window.

18. The method of claim 17, comprising:

expanding said centralizer or allowing it to expand after it clears said smaller tubing for support from said larger tubing.

19. The method of claim 18, comprising:

bringing opposed ends of the centralizer into contact with said larger tubular member for support while leaving a portion in between said ends spaced from said larger tubular member to define at least one guiding passage in the interior of said centralizer between said ends.

20. The method of claim 19, comprising:

restraining between said ends so that said ends expand radially more than in between to define said guiding passage therethrough.

21. The method of claim 19, comprising:

aligning said guiding passage with a ramp on said whipstock.

22. The method of claim 17, comprising:

retrieving said whipstock through said centralizer.

23. The method of claim 19, comprising:

making said guiding passage for guiding said mill larger than the centralizer outer dimension when delivered though said smaller tubular.

24. The method of claim 23, comprising:

further enlarging said guiding passage after said milling the window;

removing said whipstock through said further enlarged guiding passage.

25. The method of claim 19, comprising:

forming said centralizer from a cylinder with slits that open into generally diamond shaped openings on expansion;

coating said ends with a material to enhance grip when against said larger tubular.

26. The method of claim 19, comprising:

providing cantilevered fingers from a core body that are outwardly sprung, initially restrained and extending in opposed directions when passing said centralizer through said smaller tubing;

releasing said fingers to engage said larger tubular to support said centralizer;

expanding said core to an internal dimension larger than its initial outer dimension.

27. The method of claim 18, comprising:

using an inflatable for said expanding.

28. The method of claim 18, comprising:

removing said centralizer through said smaller tubing.

29. The method of claim 28, comprising:

collapsing, dissolving or milling said centralizer prior to said removing.

30. The method of claim 18, comprising:

making said centralizer from a shape memory material.

* * * * *